US005996649A

United States Patent [19]

Sutton et al.

[11] Patent Number: 5,996,649

[45] Date of Patent: Dec. 7, 1999

[54] APPARATUS AND METHOD FOR METERING AND TRANSFER OF CRYOGENIC LIQUIDS

[75] Inventors: Harold E. Sutton, Fort Collins, Colo.; Roy E. Adkins, Catlett, Va.

[73] Assignee: Cryogenic Fuels, Inc., Manassas, Va.

[21] Appl. No.: 09/094,659

[22] Filed: Jun. 15, 1998

Related U.S. Application Data

[62] Division of application No. 08/315,713, Sep. 30, 1994, Pat. No. 5,765,602, which is a division of application No. 07/888,851, May 27, 1992, Pat. No. 5,353,849.

[51] Int. Cl.[6] ..... B65B 1/04

[52] U.S. Cl. ..... 141/59; 141/198; 141/83; 141/44

[58] Field of Search ..... 141/44–46, 59, 141/387, 82, 83, 279, 18, 302, 305, 383–386, 206, 198, 207; 137/595, 587–589

[56] References Cited

U.S. PATENT DOCUMENTS 5,156,199 10/1992 Hartsell, Jr. et al. ..... 141/83

5,301,723 4/1994 Goode ..... 141/59

*Primary Examiner*—Steven O. Douglas

[57] ABSTRACT

An apparatus and method for efficiently metering and transferring a cryogenic liquid, such as liquefied natural gas, from a storage vessel to, for example, a vehicle fuel tank. The apparatus incorporates a programmable controller, a motor-driven pump and a network of conduits with motor-operated valves and liquid sensors for effecting a priming of the pump with liquid free of vapor and a cool-down of the flow passages prior to a transfer operation for ensuring that a vapor-free liquid is delivered. A pair of flow meters, one for liquid and the other for returned vapor, allows a reliable determination of the amount of liquid delivered to—and remaining in—a receiving vessel. The apparatus employs a delivery nozzle with quick-disconnect valved fittings and a delivery nozzle incorporating features which allow it to be handled by an operator without the use of heavy gloves. The method of transferring a cryogenic liquid employs an operating sequence with programmed time delays for ensuring that the liquid pump is properly primed and that the transfer apparatus is cooled down before liquid transfer begins.

1 Claim, 5 Drawing Sheets

APPARATUS AND METHOD FOR METERING AND TRANSFER OF CRYOGENIC LIQUIDS

This application is a division of application Ser. No. 08/315,713, filed on Sep. 30, 1994, now U.S. Pat. No. 5,765,602, which was a division of application Ser. No. 07/888,851, filed on May 27, 1992, now U.S. Pat. No. 5,353,849.

BACKGROUND OF THE INVENTION

1. Field of the Invention

The present invention relates to an apparatus and a method for metering and transferring an extremely cold liquid from a supply vessel to a receiving vessel. The liquids intended for transfer by the apparatus and method of this invention exist as a gas at normal atmospheric temperature and pressure and will hereafter in this specification be identified as cryogenic liquids. The present invention is particularly adapted for, but not limited to, the efficient transfer of cryogenic liquid fuels, especially liquefied natural gas (LNG), or methane, from a storage tank to a vehicle fuel tank.

2. Description of Prior Art

Known apparatuses and methods for effecting the transfer of cryogenic liquids require a series of manual operations which require skilled operators, entail substantial time and expense and invite damage to equipment and loss of valuable cryogenic liquids. Also, due to the extremely cold temperatures of the liquids being handled, discomfort or injury to operating personnel are likely. In addition, because these liquids have a strong tendency to vaporize when exposed to normal atmospheric temperatures and pressures, it becomes difficult to meter the liquids and to realize flow rates that allow for expeditious liquid transfer.

OBJECTS OF THE INVENTION AND SUMMARY

An object of the present invention is to effect the metering and transfer of cryogenic liquids reliably without requiring an undue number of manual operations.

Another object of the present invention is to realize a transfer of cryogenic liquids at relatively high flow rates. Another object of the invention is to reliably meter the liquid which is delivered to—and remains within—a receiving vessel.

Another object of the present invention is to protect an operator from discomfort or injury while using apparatus handling liquids at extremely low temperatures.

The foregoing objects of the invention, and others as well, are realized by the apparatus and method of the present invention which employs a programmable controller for carrying out a sequence of operations with a minimum of manual steps. The apparatus employs a motor-driven pump and a network of valves and liquid sensors for ensuring that the pump is filled with liquid before it is operated and that vapor-free liquid is delivered. The apparatus further employs a delivery nozzle which facilitates coupling with a receiving vessel and enables operator handling without the use of protective equipment or clothing. A metering system incorporated into the apparatus allows a reliable determination of the amount of liquid received and remaining in a receiving vessel.

The detailed description provided below together with the accompanying drawings will afford a further understanding of the present invention. Any specific embodiment which is disclosed should be regarded as illustrative and not restrictive of the scope of the invention, since obvious modifications of such an embodiment of the present invention will occur to persons of ordinary skill in the art having the benefit of this disclosure.

DESCRIPTION OF PREFERRED EMBODIMENTS

Figure 1:
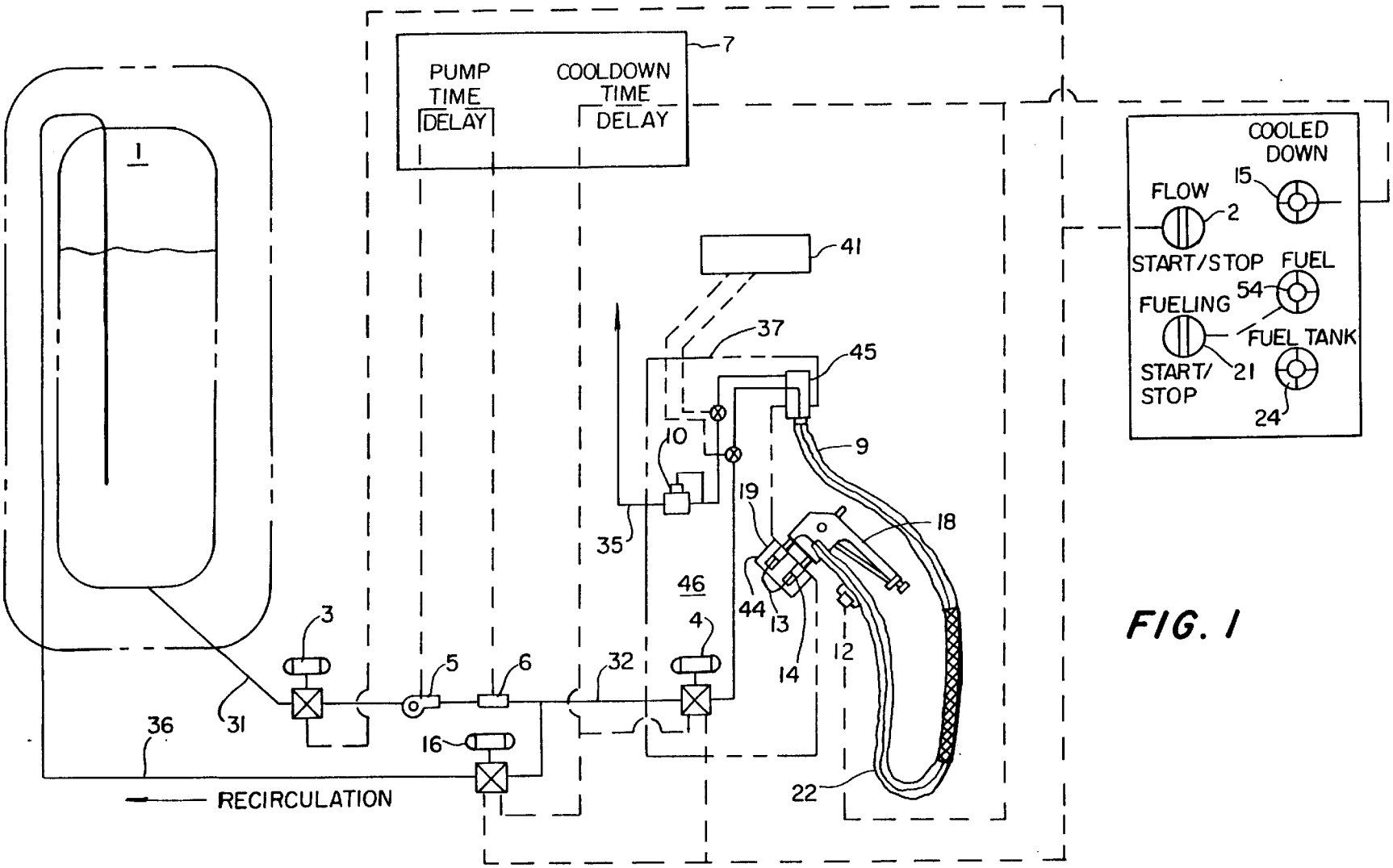
FIG. 1 shows schematically an LNG metering and transfer apparatus with the delivery nozzle disposed in a storage and cool-down position.

As shown in FIG. 1, a conduit 31 provides a flow path for the liquid contents of LNG tank 1 to flow to the intake of a motor-driven pump 5. A conduit 32 provides a flow path from the pump discharge to a flexible delivery conduit 9. Within the delivery conduit are an inner passage, serving as an extension of conduit 32 and an annular outer passage 22 for return flow of vapor to a vapor recovery system by way of conduit 35 provided with pressure regulator 10. A delivery nozzle 18 is coupled to the free end of the flexible conduit and is provided with valved quick-disconnect fittings separately coupled to the inner and outer passages of the flexible conduit.

Motor-operated valves 3 and 4 are provided in conduits 31 and 32, respectively. A third motor-operated valve 16 is provided in recirculation conduit 36 extending from conduit 32, at a location between the pump discharge and valve 4, to the LNG tank. Conduit 32 is provided with a liquid sensor 6 at a location just downstream of the pump discharge. A second liquid sensor 12 communicates with the outer passage of the flexible conduit 9 adjacent the delivery nozzle. The liquid sensors provide voltage signals to a programmable controller, or microprocessor, 7 when they are immersed in liquid. The motor-operated valves receive operating signals from the programmable controller. Because of their quick response, electrically controlled, pneumatically operated valves are especially suitable choices for motor-operated valves 3, 4 and 16.

An operator control panel, located, for example, in a dispensing pedestal 37, is electrically linked to the programmable controller 7, to valves 3, 4 and 16 and to liquid sensor 12. The panel is provided with switches 2 and 21 and with indicator lights 15, 24 and 54.

The delivery nozzle is shown in a storage and cool-down position on a support 19 which could be incorporated in the dispensing pedestal 37, as shown. The support includes quick-disconnect valved fittings which couple with the valved fittings on the delivery nozzle. A short conduit 13 provides a flow path between the valved fittings on the support.

In FIG. 1, the delivery nozzle 18 is shown removed from its storage and cool-down position and is coupled to a vehicle fuel tank 23. The vehicle fuel tank includes quick-disconnect valved fittings 33 and 34 which couple with the valved fittings on the delivery nozzle. As shown, fitting 33 communicates with the vapor head space in the vehicle fuel tank; this fitting couples with the fitting on the delivery nozzle which communicates with the outer vapor return passage of the flexible conduit 9. Liquid fuel flows into the vehicle fuel tank through fitting 34 which couples with the fitting on the delivery nozzle in communication with the inner passage of the flexible conduit.

The transfer apparatus of the present invention is designed to accurately measure the amount of LNG delivered to—and remaining in—the vehicle fuel tank, in full compliance with the standards specified in *National Bureau of Technology and Standards Handbook* 44—*Weights and Measurements*. For this purpose, conduit 32 is provided with a flow meter 39, and conduit 35 is provided with flow meter 40. Meters 39 and 40 develop signals representative of the mass flows of liquid and vapor, respectively. These signals are fed to a flow compensator 41 incorporating an electrical circuit which subtracts the vapor flow from the liquid flow to afford a reliable measurement of the net liquid mass delivered to—and remaining in—the vehicle fuel tank. The net liquid mass delivered to the vehicle fuel tank can be read from, for example, a digital display.

To ensure the safety of the apparatus, the top of the dispensing pedestal can be provided with a methane sensor, which upon sensing a predetermined methane level, will activate, for example, lights and alarms.

Figure 2:
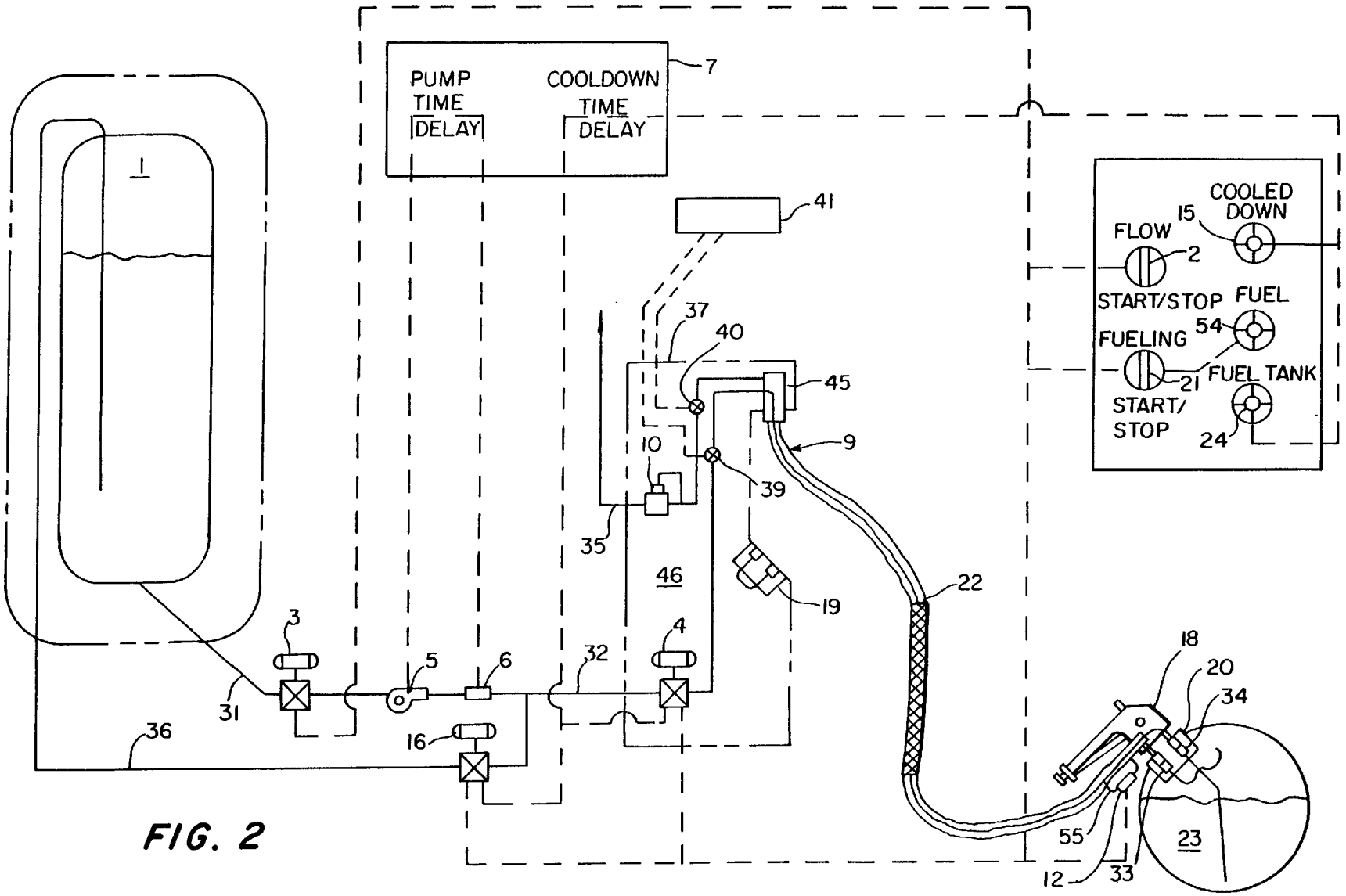
FIG. 2 shows schematically an LNG metering and transfer apparatus with the delivery nozzle coupled to a vehicle fuel tank.

To begin a fueling operation, the operator initiates a cool-down cycle with the delivery nozzle on the support 19 in the storage and cool-down position, as shown in FIG 2. Placing switch 2 in the start position opens valves 3 and 4. The liquid contents of the LNG tank, under a higher-than-atmospheric pressure, will flow from the tank, through pump 5 and past sensor 6 just downstream of the pump. When sensor 6 is immersed in liquid, it provides a voltage signal to programmable controller 7. To ensure that the pump is fully primed with a liquid charge and is free of any vapor, the programmable controller incorporates a time delay, so that it does not send an energizing signal to pump 5 until a predetermined time has passed since liquid sensor 6 first provided a signal to the programmable controller. (Because of plumbing and other equipment variables, the length of the time delay will be determined individually for each installation.)

With the pump energized, liquid will flow through conduit 32, through the inner passage in flexible conduit 9, through one pair of valved fittings, through conduit 13, through the other pair of valved fittings and into the outer passage of the flexible conduit. When liquid sensor 12 is immersed in liquid, it provides a voltage signal to programmable controller 7. The programmable controller immediately sends signals to open valve 16 and close valve 4, thereby effecting a recirculation of liquid discharged from pump 5 to LNG tank via conduit 36. The signal from liquid sensor also energizes cool-down light 15 on the operator control panel to indicate that fueling of a vehicle fuel tank may proceed. A second time delay incorporated into the programmable controller will initiate another cool-down cycle if fueling of the vehicle tank does not begin within a predetermined time. This will ensure that liquid, not vapors, will be delivered to the vehicle fuel tank.

To deliver fuel to the vehicle tank, the delivery nozzle is removed from support 19 and coupled to the valved fittings on the tank. Switch 21 on the operator control panel is then placed in the start position, to open valve 4 and close valve 3 and also energize fueling light 54 on the panel. Liquid will then flow into the vehicle fuel tank and vapors in the tank will flow from the tank via the outer passage in flexible conduit 9 and conduit 35. When the tank is full, as determined by the position of the open end of a tube connected to valved fitting 33, liquid will flow into the outer passage of flexible conduit 9. When sensor 12 is immersed in liquid it will send a voltage signal to programmable controller 7. This signal will also energize the "full tank" light 24 on the operator control panel. In response to the signal from the liquid sensor 12, the programmable controller will open valve 16 and close valve 4 to effect a recirculation of liquid from the pump back to the LNG tank and begin a time delay period. During this time delay (the same time delay employed for the cool-down cycle), the delivery nozzle 18 will be removed from the vehicle fuel tank and placed on the support 19. When the time delay period expires, a cool-down cycle will automatically be initiated if sensor 12 is not immersed in liquid.

Figure 3:
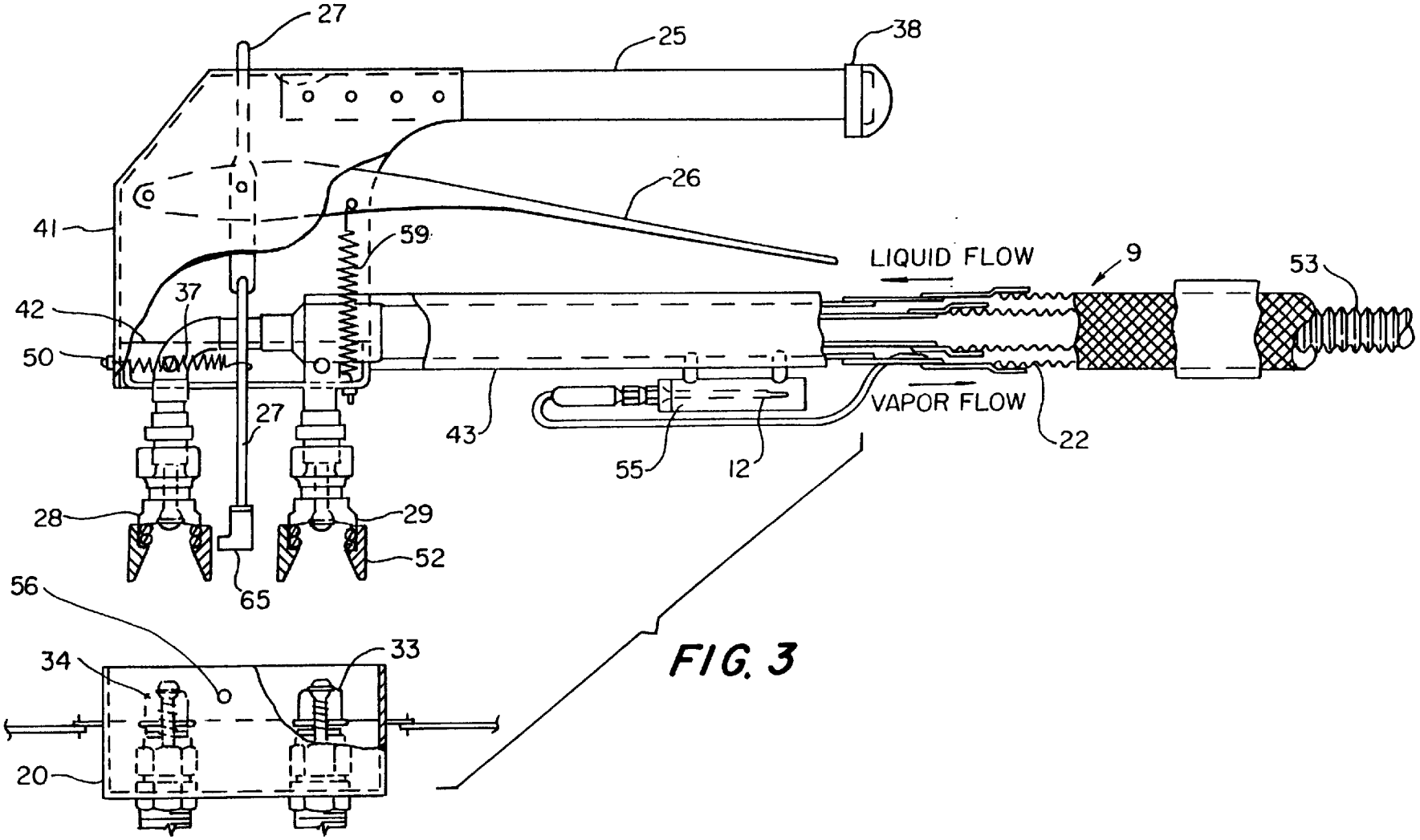
FIG. 3 shows a delivery nozzle, with valved fittings, disengaged from mating valved fittings.

Referring now to FIG. 3, the delivery nozzle is shown out of engagement with the valved fittings 33, 34 on the vehicle fuel tank. (Valved fittings 33, 34 are like the valved fittings on the support 19 used when the delivery nozzle is in a storage and support position.) The nozzle includes a flow section with an insulating sleeve 43; the flow section has formed therein inner and outer concentric passages communicating respectively with the inner and outer passages of the flexible conduit 9. Liquid sensor 12 is shown positioned in a short bypass chamber 55 communicating at its ends with the outer flow passage. Valved fittings 28 and 29 extending through a bracket 40 at the delivery end of the flow section communicate respectively with the inner and outer passages of the flow section. Each of the valved fittings includes a socket 32 with a tapered entrance surface. Around the interior wall of each socket is a radial seal, of TEFLON, for example, and at the inner end of each socket is an axial seal for insuring a leak-proof coupling when the sockets are forced down over the valved fittings 33, 34 on the vehicle fuel tank. A hand grip 25 is laterally displaced from the flow section and is joined to the flow section by a shroud 41. A hand lever 26 is pivotally mounted within the shroud and pivotally carries a locking rod 27 provided at its lower end with a flanged shoe 35. Lever 26 is biased away from hand grip 25 by spring 39, and locking rod is biased forwardly by spring 40. A locking ring 38 is slidably carried on handgrip 25. Heat conduction between the hand grip 25 and the flow section is minimized by the use of thermal isolators 40 between the shroud 41 and bracket 42, by heat conductive paths of small cross-section and by insulation sleeve 43.

Figure 4:
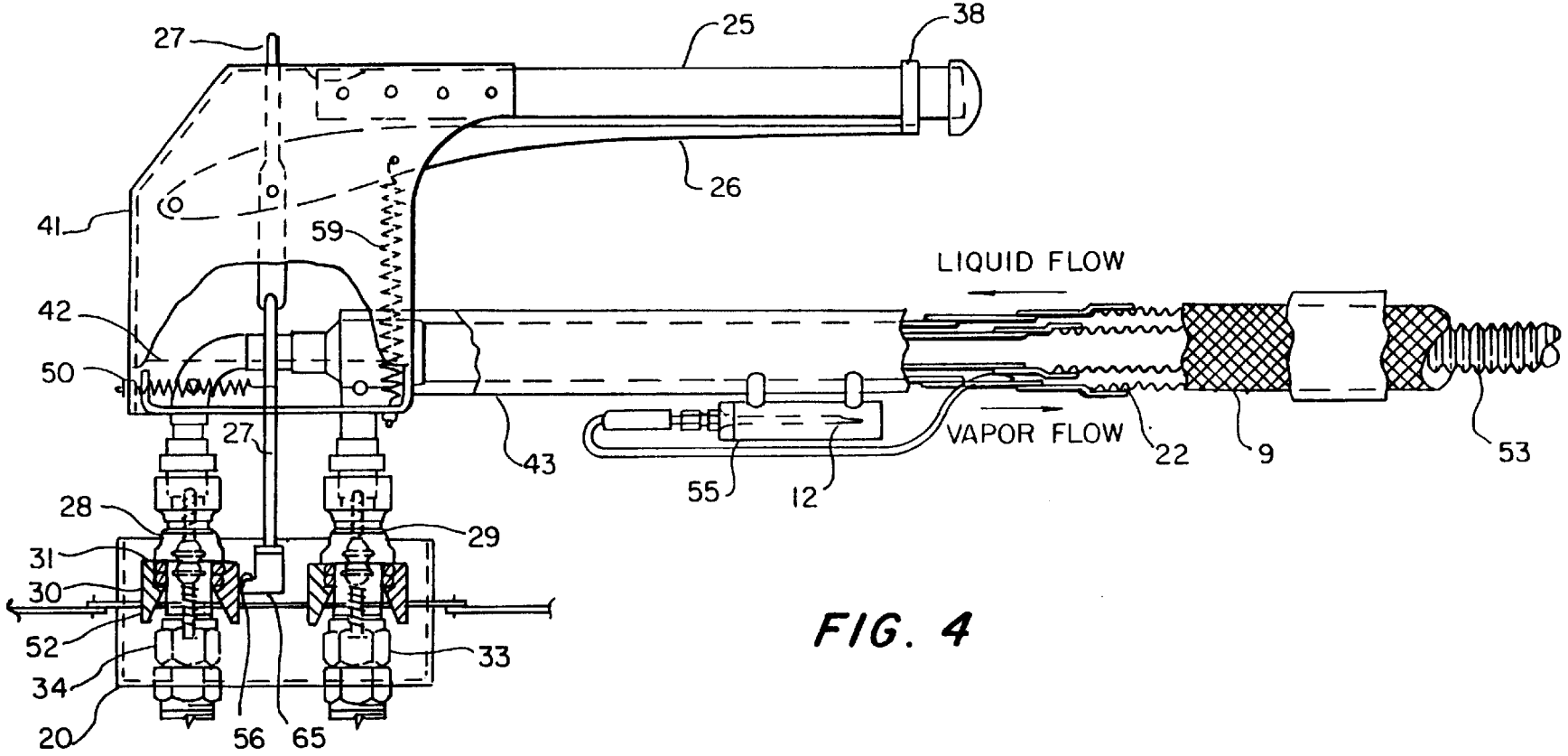
FIG. 4 shows a delivery nozzle, with valved fittings, in engagement with mating valved fittings.

In FIG. 4, the delivery nozzle is shown with its valved fittings coupled to the mating valved fittings on the vehicle fuel tank. This coupling is effected by fitting the sockets 32 over the nipple-like valved fittings 33, 34 on the vehicle fuel tank. The flange on the shoe 35 of locking rod 27 is positioned under an abutment 36 fixed to the support for valved fittings 33, 34. Lever 26 is then pulled up to pull the sockets 32 snugly over the valved fittings 33, 34. If desired, lever 26 may be held in its upward position by sliding locking ring 38 forwardly along the hand grip 25 and over the end of the lever. To release the coupling of the valved fittings, the upper end of locking rod 27 is pivoted forwardly, thus releasing the flange on the shoe from its engagement under abutment 27.

Figure 6:
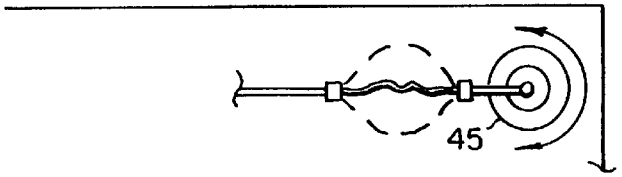
FIG. 6 shows the movement of flex hoses employed in an arrangement for accommodating swiveling of a flexible, torsionally rigid, delivery conduit, as shown in FIG. 5.
Figure 5:
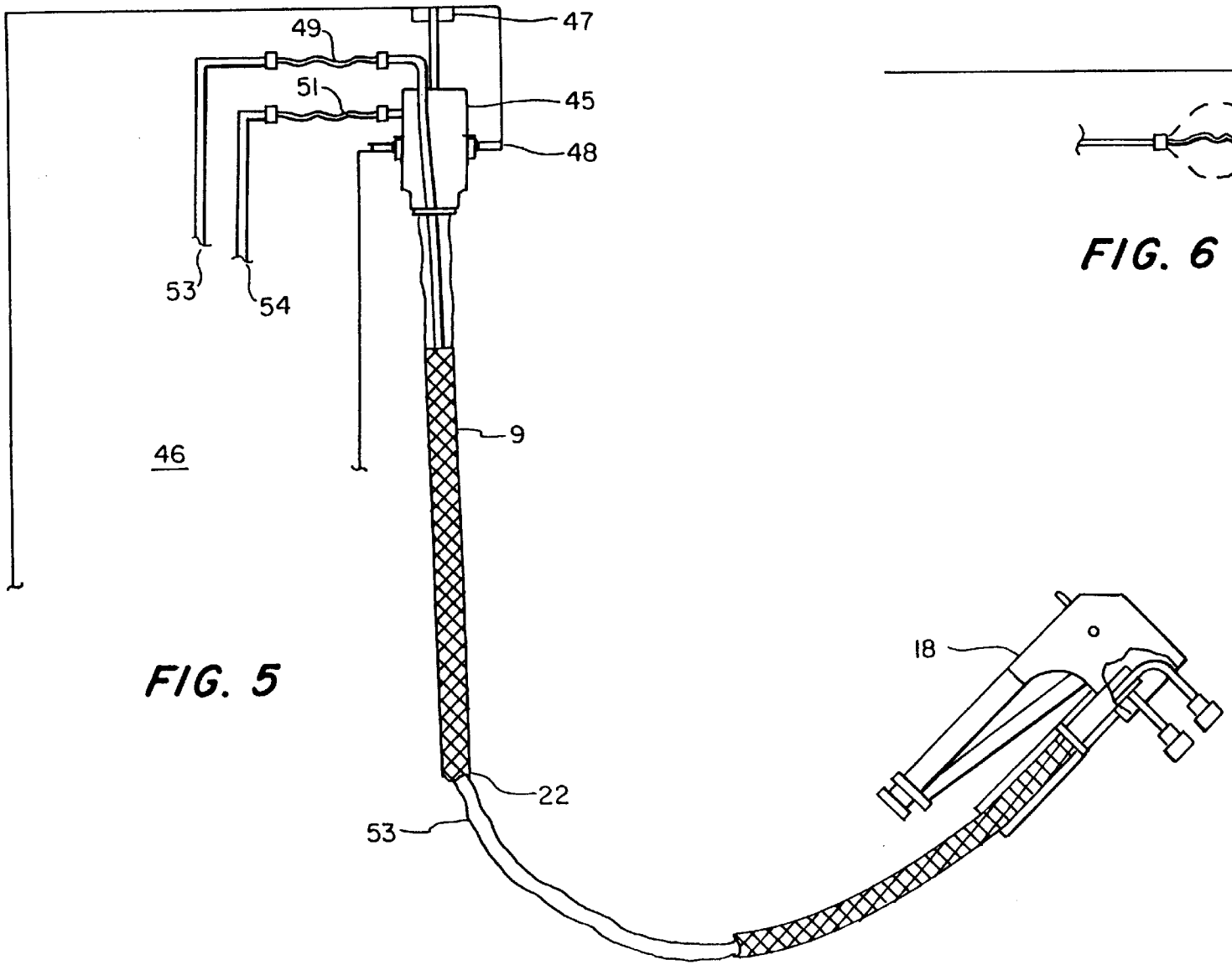
FIG. 5 shows an arrangement for accommodating swiveling of a flexible, torsionally rigid, delivery conduit.

An especially suitable flexible conduit 9 for use with the present invention incorporates inner and outer concentrically arranged conduits formed of corrugated stainless steel. Such a hose exhibits substantial rigidity to torsional forces. To accommodate swiveling of the conduit where it is joined to the dispensing pedestal, without the use of dynamic seals, a torque relief arrangement, employing side-by-side flex hoses, as shown in FIG. 5 may be used. A housing 45 is joined to the end of the flexible conduit and is rotatably supported in a bearing 48 fitted in the pedestal. The interior of housing 45 communicates with the outer passage of the flexible conduit and is joined via a stub fitting with a flex hose 50; flex hose 50 is joined at its other end to fixed conduit 52. A conduit within housing 45 is joined via an L-fitting to flex hose 49; the other end of flex hose 49 is joined to fixed conduit 51. The flexing of hoses 49 in response to swiveling of housing 45 is shown in FIG. 6.

Variations or modifications of the above-described invention which would be obvious to persons of ordinary skill in the art are to be regarded as falling within the scope of the invention as defined in the following claims.

We claim:

1. Apparatus for metering a cryogenic liquid being delivered to a receiving vessel, said apparatus comprising:

a first conduit providing a liquid flow path to said receiving vessel;

a flow meter in said first conduit for developing a first signal representative of the mass flow rate through said first conduit;

a second conduit providing a vapor return flow path from said receiving vessel;

a flow meter in said second conduit for developing a second signal representative of the mass flow rate through said second conduit; and means for subtracting said second signal from said first signal to thereby determine the net mass of liquid delivered to said receiving vessel.

* * * * *